US007054567B2

(12) United States Patent
Furno et al.

(10) Patent No.: US 7,054,567 B2
(45) Date of Patent: May 30, 2006

(54) INITIALIZATION METHOD FOR ESTABLISHING PROCESS CONTROL PARAMETERS

(75) Inventors: Joseph J. Furno, Rochester, NY (US); Richard G. Allen, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 78 days.

(21) Appl. No.: 10/681,849

(22) Filed: Oct. 8, 2003

(65) Prior Publication Data

US 2004/0096230 A1 May 20, 2004

Related U.S. Application Data

(60) Provisional application No. 60/426,736, filed on Nov. 15, 2002.

(51) Int. Cl.
*G03G 15/00* (2006.01)

(52) U.S. Cl. ..... 399/38

(58) Field of Classification Search ..... 399/38, 399/299, 300, 306, 46
See application file for complete search history.

(56) References Cited

U.S. PATENT DOCUMENTS 6,530,638 B1 * 3/2003 Shibata et al. ..... 347/15
6,636,326 B1 * 10/2003 Zuber ..... 358/1.14

* cited by examiner

*Primary Examiner*—Quana Grainger
(74) *Attorney, Agent, or Firm*—Justin D. Petruzzelli

(57) ABSTRACT

An automatic process of setting control set-points, control rates, calibrations, timing parameters and maximum density levels for color modules within a color print engine by utilizing addressable settings of multiple configurable parameters for each color module. The parameters can be independently controlled and maintained. Each color module maintains a list of parameters by storing the parametric values in a non-volatile memory. At initialization, the parameters for each module are read out of the non-volatile memory to set the correct settings for the specific color module.

5 Claims, 4 Drawing Sheets

INITIALIZATION METHOD FOR ESTABLISHING PROCESS CONTROL PARAMETERS

CROSS REFERENCE TO RELATED APPLICATIONS

This application claims priority of U.S. Provisional patent application Ser. No. 60/426,736, entitled: INITIALIZATION METHOD FOR ESTABLISHING PROCESS CONTROL PARAMTETERS, filed on Nov. 15, 2002.

FIELD OF THE INVENTION

The present invention relates to parametric control of color printing modules, and more particularly to the automated employment of distributed parameters for multiple color modules using a single software routine.

BACKGROUND OF THE INVENTION

Color print engines employing multiple color modules exist within the prior art that have parameters such as process control set-points, control rates, calibrations, timing parameters and maximum density levels for each color module that typically, are set to a predetermined level at initialization. However, the optimum values for these parameters can differ for each color module and the same parameter can vary over time. These prior art systems typically provide parameter values for each color module during initialization. In order to change these initial settings, manual intervention is usually required. Once the parameters are initialized, the settings or personality of each color module is established. This manual intervention requires skilled effort on the part of machine operators and can result in less than optimum performance of the color print engine. Accordingly, there is a need within the prior art for automated techniques that initialize and update these parameters.

In view of the foregoing discussion, there remains a need within the art for an automated system and method for providing process controls, calibrations, and timing parameters to provide superior control for each color module.

SUMMARY OF THE INVENTION

The invention addresses the aforesaid needs within the art of color print engines employing multiple color modules by automatically providing different process control set-points, control rates, calibrations, timing parameters and maximum density levels for each color module. The invention realizes these settings through multiple configurable parameters for each color module. The parameters can be independently controlled and maintained. Each color module maintains a list of parameters by storing the parametric values in a non-volatile memory. At initialization, the parameters for each module are read out of the non-volatile memory to set the correct settings for the specific color module.

The system software maintains an array or parameter value for each color module and defines the order of color application and color module positioning. During initialization, the software uses a communication bus with node identifications for the inputs to each color module to properly initialize the parameters for each color module to the correct color settings. During initialization, each color module has parameters set using a unique identification number that allows fully independent configuration and control for each color module. Once the parameters are initialized, the settings or personality of each color module is established. The invention employs system software to perform regular checks on the various components for each color module to insure that they match the personality loaded.

These and other features are provided by the invention in a color printing system having multiple color modules, at least one processing element associated with the color modules, a set of configurable parameters for each of the color modules stored such that it is accessible by the processing elements and a manner for updating the configurable parameters.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1A:
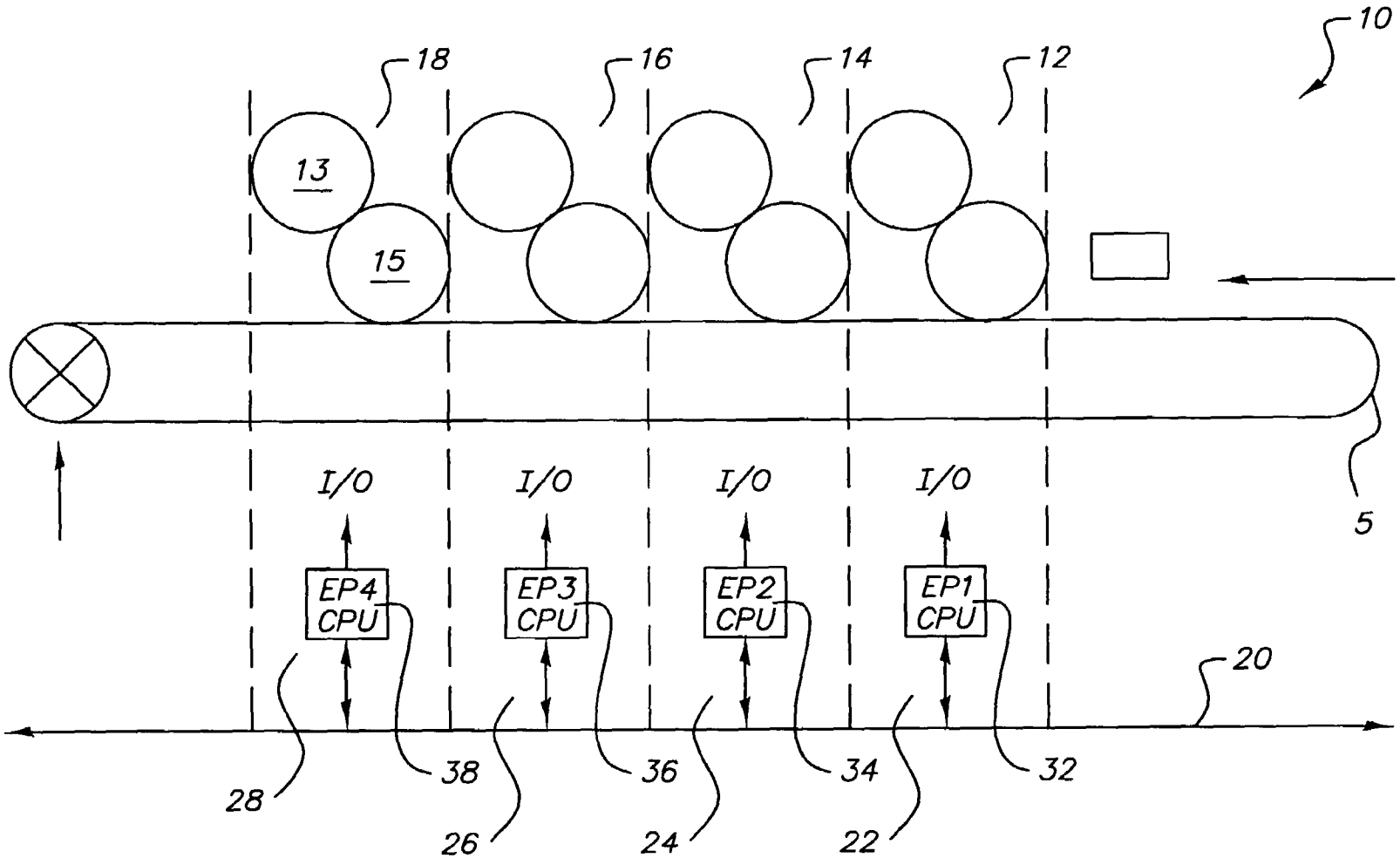
FIG. 1*a* is a high level diagram of a color printing system of the invention.
Figure 1B:
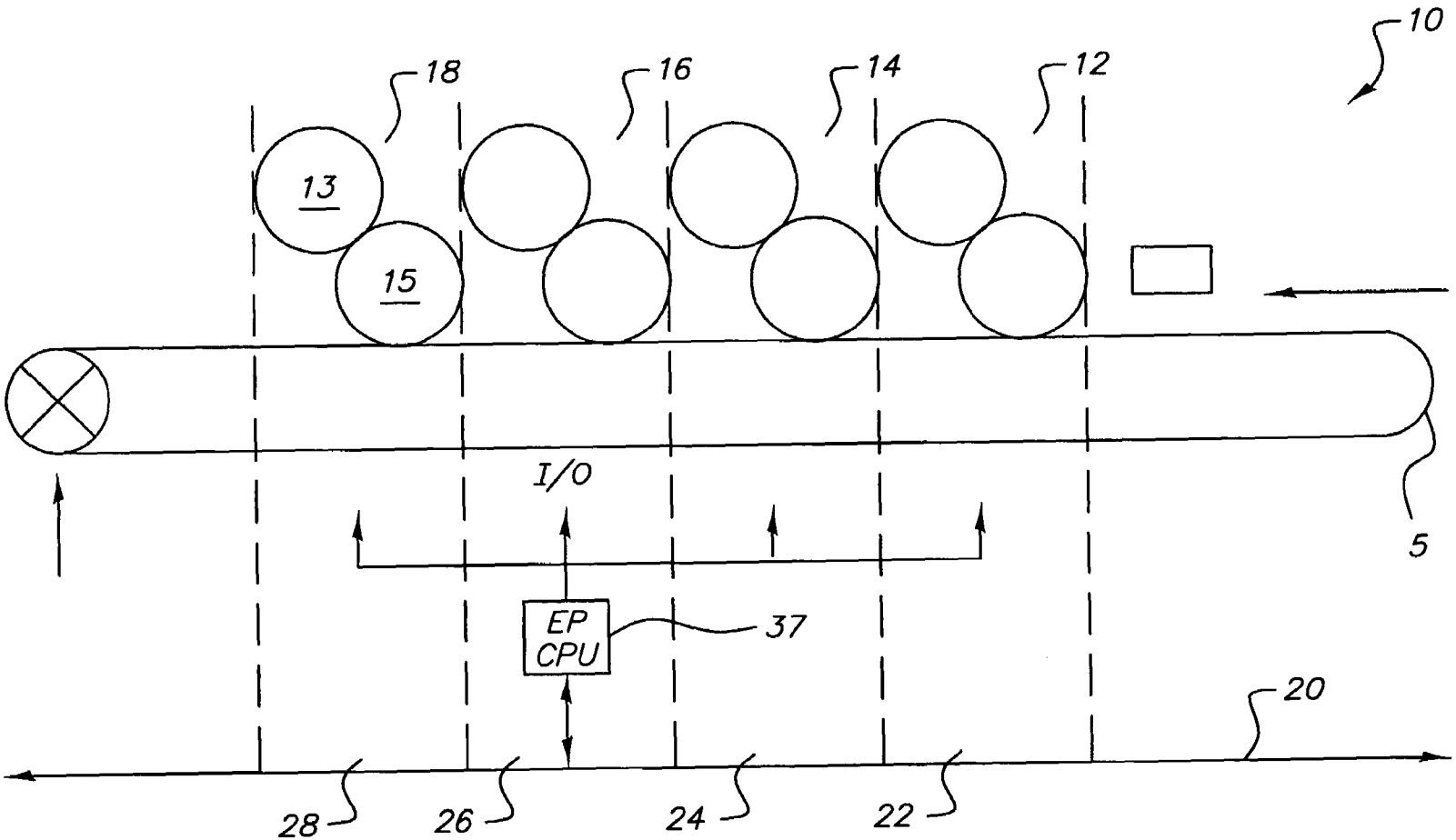
FIG. 1*b*, similar to a1, is a high level system of an alternate embodiment of the invention.

Referring to FIGS. 1*a* and 1*b*, which are illustrations of the color printer engine 10 used within the preferred embodiment of the invention, four electrophotographic (EP) modules 22, 24, 26, 28 have respective color modules 12, 14, 16, 18. The color printer engine 10 has the ability to automatically process and control set-points, control rates, calibrations, timing parameters and maximum density levels for the color modules 12, 14, 16, 18 through the use of multiple parameters that are configurable for each of the color modules 12, 14, 16, 18. The invention envisions that these parameters can be independently controlled and maintained. The color modules 12, 14, 16, 18 each maintain a list of parameters identifications (PIDs) that are retained as parametric values stored in a non-volatile memory. The stored parameters are stored locally to allow access by one of the Central Processing Units (CPUs) 32, 34, 36, 38 that are associated with each of the color modules 12, 14, 16, 18. The result is to create a distributed processing environment wherein CPUs 32, 34, 36, 38 are individually associated with respective EP modules 22, 24, 26, 28. The PIDs are applied to system software that is controlled by the master processor 30 across the common bus. The CPUs 32, 34, 36, 38 are slave devices to master processor 30 in the preferred embodiment illustrated in FIG. 1*a*. It will be understood that instead of employing a processor with individual modules, that a single processor 37, shown in FIG. 1*b* can track and update separate tables containing PIDs for each module.

The color print engine 10 illustrated in FIGS. 1*a*, 1*b* has multiple EP modules 22, 24, 26, 28, however, the number of EP modules 22, 24, 26, 28 is not limited to four, and it is for example envisioned that there be a fifth module (not shown). Furthermore, the color print engine 10 is not limited to a particular number or configuration of modules. The EP modules 22, 24, 26, 28 are typically configured to contain a different color toner and, therefore, the EP modules 22, 24, 26, 28 will each typically require a different setting for process control set-points, control rates, calibrations, timing parameters, and maximum density levels. Each of these settings can be realized through application of multiple configurable parameters for each of the EP modules 22, 24, 26, 28, allowing independent control and maintenance of the settings. A list of PIDs are maintained for each of the EP modules 22, 24, 26, 28, and the list of PIDs is preferably stored in non-volatile memory that is locally accessible to their respective CPUs 32, 34, 36, 38, in order that the PIDs are not lost during power-down. As previously stated, a single processing element (37 of FIG. 1*b*) could be employed with a suitable communication bus structure whereby all the lists for the PIDs could be maintained by the single processing element.

An initialization process will take place during the assembly of the print engine or during software installation. Initialization requires that the PIDs for each module be set to the correct settings for the specific color module 12, 14, 16, 18. The invention envisions that each of the CPUs 32, 34, 36, 38 (or single CPU 37) operate on the same software supplied by the system to control the individual EP modules 22, 24, 26, 28 via implementation of the PIDs that are specific for each of the color modules 12, 14, 16, 18. The system software for the color printer engine 10 maintains parameter values for each of the color modules 12, 14, 16, 18 that are currently defined for the print engine. The color printer engine 10, also defines the order of application and positioning for each of the color modules 12, 14, 16, 18. During the initialization process, the system software uses a communication bus 20 attached to several addressable nodes as inputs for each color module 12, 14, 16, 18 in order to initialize the PIDs. The node identification within the preferred embodiment is referred to as the Node ID and the communication bus 20 is preferably an ARCNET® communication ring. The node identification procedure employed by the invention is not limited to being implemented on an ARCNET® communication ring and could easily be extended to a TCP/IP address if the communication bus 20 employed uses an Ethernet TCP/IP communication protocol. Additional communication busses are equally well suited for the invention based on specific designs.

During this initialization process, each of the color modules 12, 14, 16, 18 will have PIDs set using a unique identification number that allows fully independent configuration and control for the PIDs to each of the EP modules 22, 24, 26, 28 by an external user. Once the PIDs are initialized, the settings, or personality, for each of the color modules 12, 14, 16, 18 is established. The invention employs system software to perform regular checks on the various components of the color modules 12, 14, 16, 18 to insure that they match the personality that has been previously loaded. For example, in the preferred embodiment, the color modules 12, 14, 16, 18 are electrophotographic modules wherein color identifications are read from the toning station TS (FIG. 3) and replenishing units to be compared with the expected colors defined by the PIDs. If the color identifications do not match the PIDs, there are possible hardware problems, toning station TS color mismatching, or improper seating of the toning and replenisher subsystems. As more toners/colors are developed, configuration files can be maintained externally and loaded into the PIDs for each of the EP modules 22, 24, 26, 28, to create new process control settings.

The present invention allows added flexibility to the order in which the color/toner is applied, and provides for dynamic configuration in the application of the color/toner. During the initialization process, the system software will be able to interrogate the toning station TS identifications within each of the color modules 12, 14, 16, 18 and initialize the parameter sets accordingly, rather than having a fixed order method using the communication bus 20 node/address. The configurable parameter settings can be loaded and/or exchanged between modules and allow the running of specific jobs that require different color toners or require different color application orders to create desired special effects.

Figure 2:
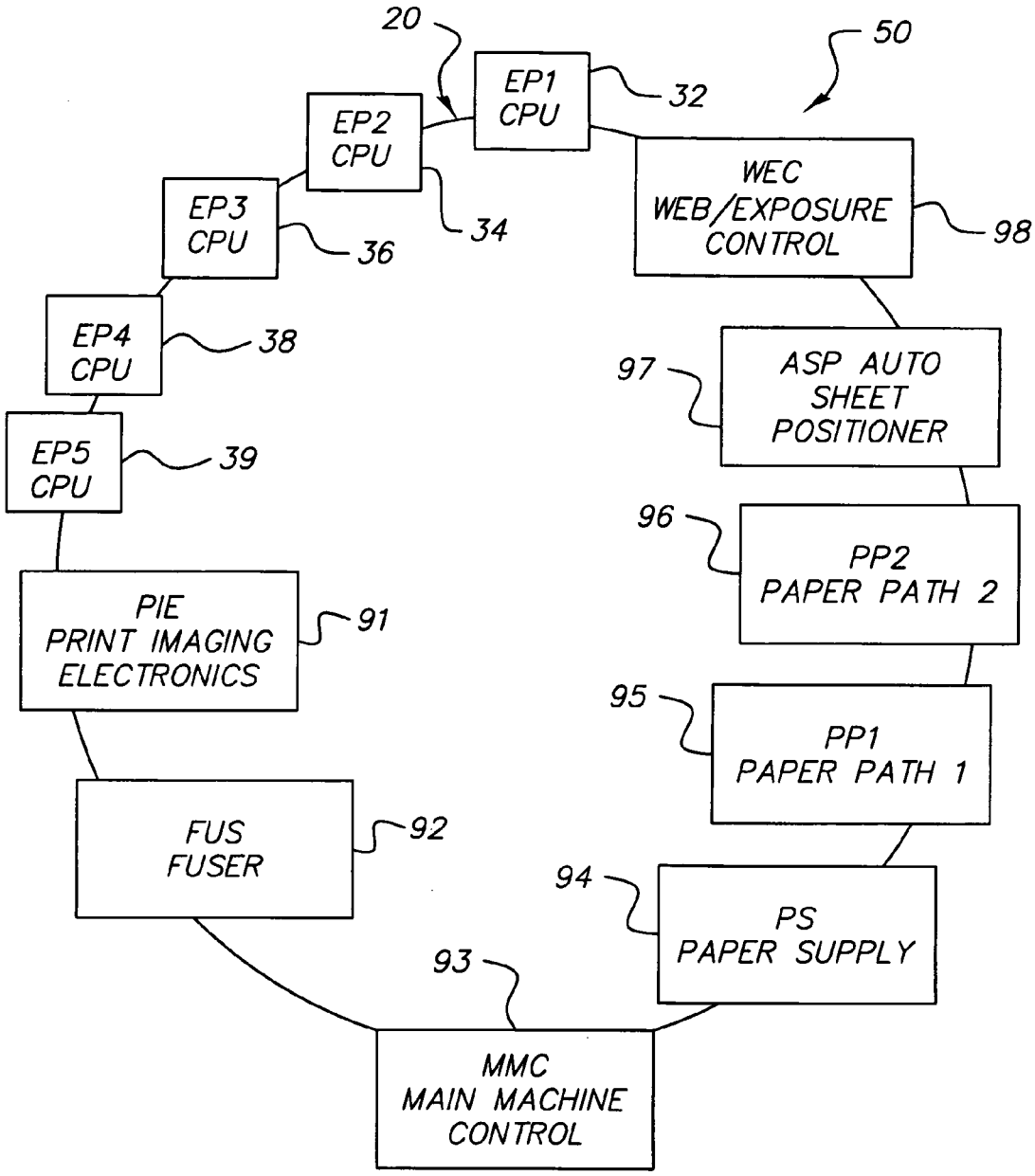
FIG. 2 is a diagram illustrating the various components that are individually addressable on a common bus.

Referring now to FIG. 2, the communication bus 20 of the preferred embodiment of the invention forms a logical ring 50 containing several independently addressable nodes. Preferably, communication bus 20 is an ARCNET® communication ring having CPUs 32, 34, 36, 38 in the first four addresses. The fifth address is another CPU 39 for a fifth color in the color printing engine 10. Additional addresses on communication bus 20 are held by Print Imaging Electronics (PIE) 91, fuser 92, Main Machine Control (MMC) 93, paper supply 94, paper path1 95, paper path2 96 Auto Sheet Positioner (ASP) 97 and Web Exposure Control (WEC) 98, which are shown for example only, and do not constitute a substantial ingredient of the invention. EP module 22, is configured for use with black toner and is an addressable node on the logical ring 50 located at address 1 through CPU 34. It is specifically envisioned that any of EP modules 22, 24, 26, 28 can be addressed by a single processor within color printer engine 10. Table 1 illustrates a few of the color dependent parameters that can be configured for use in accordance with the specific colorant used. The first EP module 22 as a functional unit, is required to have an identification that matches the color black, which is contained in Table 1 as COLOR_ID. The EP modules 22, 24, 26, 28 each have a device that identifies that module, preferably the toning station will have a physical hardware 5-bit switch which can be configured at the time toner is first installed. In the case of EP module 22, the 5-bit switch would be set to identify that module as containing toner "1", and, the software parameters for controlling black toner must match the identified color of the toning station. The 5-bit switch can identify up to thirty-two different colors, therefore, while Table 1 has only five columns, Table 1 should be looked as an example only and thirty-two colors are specifically envisioned in the present embodiment. Other addressing mechanisms could easily be configured to provide more than thirty-two color selections.

TABLE 1

| | Imaging Color | | | | |
|---|---|---|---|---|---|
| | Black | Yellow | Magenta | Cyan | Clear |
| ARCNET ® Address | 0001 | 0002 | 0003 | 0004 | 0005 |
| COLOR_ID | 1 | 2 | 3 | 4 | 5 |
| ALPHA | 65689 | 76346 | 75522 | 66627 | 203636 |
| BETA | 42697 | 49625 | 49089 | 43307 | 132363 |
| VTD_AIM | 3410 | 2934 | 2966 | 3362 | 1100 |

The parameters ALPHA and BETA contained in Table 1 control the proportional gain adjustment to electrophotographic parameters in response to measured density errors. ALPHA is the proportionality constant between a measured $V_{TD}$ (voltage transmissive density) error and the required $V_o$ change. BETA is the proportionality constant between the $V_{TD}$ error and the $E_o$ change. The ALPHA and BETA values control the magnitude of the $V_o$ and $E_o$ corrections needed to correct a density error. An increase in $V_o$ and $E_o$ yields an increase in density.

Each of the EP modules 22, 24, 26, 28 will have their individual color controlled by reading the density of the applied color via a densitometer. The densitometer receives a transmission density and reports the transmission density (as the log of the transmission density) as a 5000 millivolt per decade response. The log representation of the transmission density is then compared with the desired density, referred to herein as the aim voltage transmission density, and represented on Table 1 as $V_{TD\text{-}aim}$. For the first EP module 22, the $V_{TD\text{-}aim}$ density value is 3410 millivolts, and if the comparison of measured transmission density to the $V_{TD\text{-}aim}$ density shows that they are not equal, then a density error is generated. The occurrence of a density error is used to initiate the computation of a new electrophotographic aims for operating the primary charger, exposure and toning station as fixed ratio adjustments in proportion to the density error. The toners for each of the EP modules 22, 24, 26, 28 contain different pigments in varying concentrations, resulting in the measured density having a different relationship to the actual mass density of toner present. The electrophotographic process controls require adjustment to insure that the proper ratio of $V_o/E_o$ for the amount of mass applied, and thus the proportional gains, ALPHA and BETA will be unique for each of the EP modules 22, 24, 26, 28 according to their respective colorant.

Figure 3:
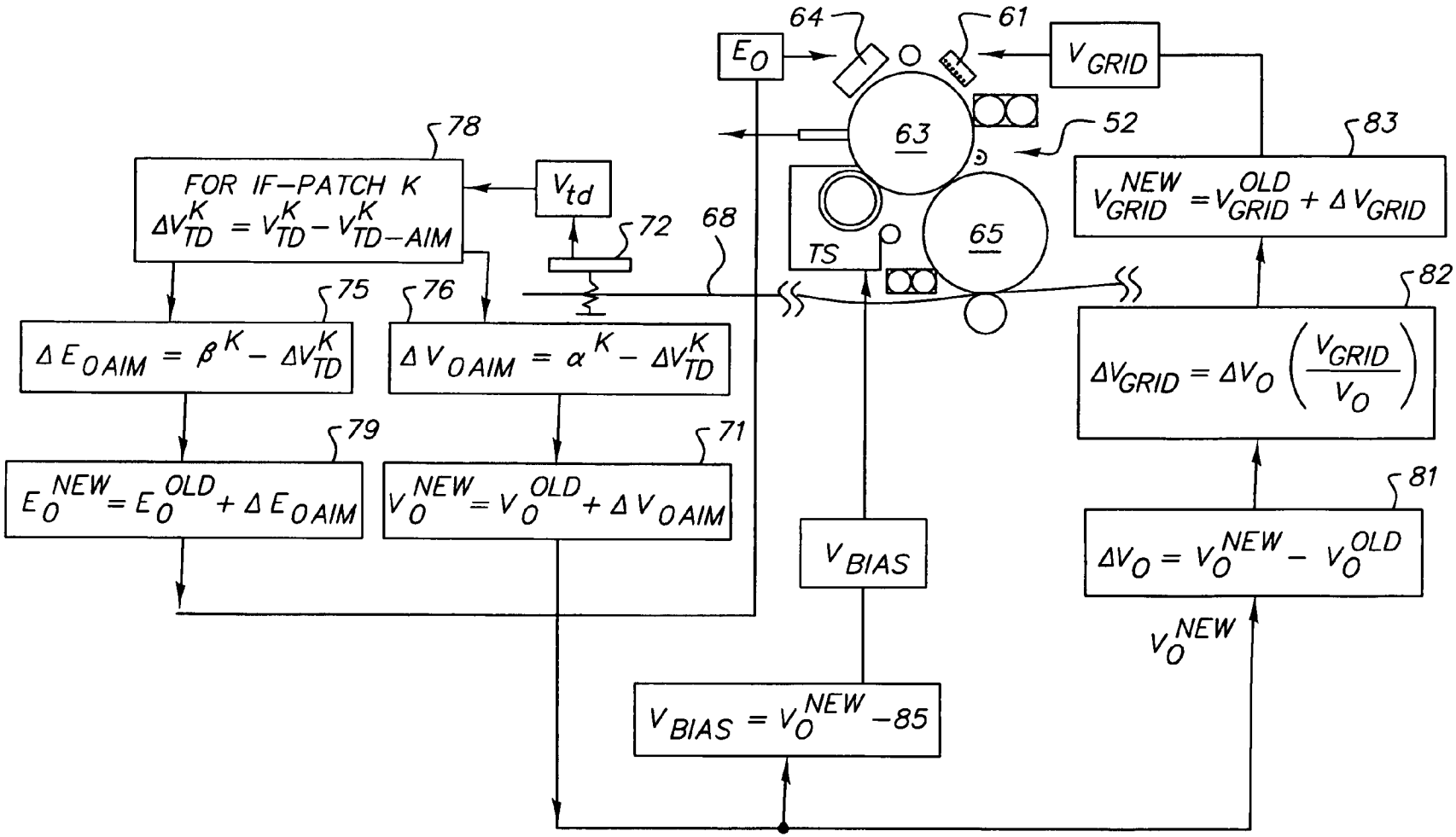
FIG. 3 is a diagram of the densitometer loop for a single color module.

FIG. 3 is a logical illustration of the process control loop used to determine the density baseline for a single color module 52. The color module 52 seen in FIG. 3 is representative of those previously discussed. The color module 52 illustrated in FIG. 3 is explicitly shown to detail the density loop. As shown in FIG. 3, an electrophotographic printing system of the module 52 includes a primary charger 61 is used to generate a surface potential on the photoconductive member 63 by spraying a defined surface charge density. The surface potential on the photoconductive member 63 immediately following the charger is referred to as $V_o$. Typically, if no other parameters are changed, the print density will increase when $V_o$ is increased. An exposure source 64 is used to image-wise illuminate the photoconductive member 63 to create a latent electrostatic image. The amount of photodischarge, measured as a change to the surface potential of the photoconductive member 63, is related to the intensity of the exposure source 64. Preferably, the exposure source 64 is a digital source wherein the image-wise exposure can be done as a multilevel exposure, as an area modulated halftone, or a mixed dot halftone which combines intensity and area modulation to form the tonal information of the image.

In multiple color electrophotographic systems, it is desirable to use the same arrangement to image toners pigmented with different colorants. The constants used in the above system must be adjusted to the particular light absorption characteristics of the colorant. For example, to be able to create a neutral density output made up of yellow, magenta and cyan pigmented toners, the mass that is applied for each of the toners needs to be uniquely defined. Likewise, each toner color will have a unique relationship between the mass amount applied and the signal received from the transmission densitometer. Thus, each colorant has a unique aim value, $V_{TD\text{-}aim}$. In addition, the proportionality constants for controlling the electrophotographic system will need to be adjusted, such that a measured $V_{TD}$ error will be corrected by adjusting $V_o$ and $E_o$.

The density loop controls the transmission density of the image transferred to the transport web 68 by fixed ratio changes to $V_o$ and $E_o$. A patch is generated in an area between receiver elements referred to as the interframe, by timing the application of the patch to the transport web 68 so that the patch does not transfer to any of the receiver elements carried by the transport web. The patch is then read by the densitometer 72. The densitometer 72 produces a voltage output in log proportion to the transmittance of the transport web 68. Determine $\Delta V_{TD}$ (78) provides adjustments values for a patch by taking the densitometer 72 reading of the transparent transport web 68 in an area where there is no receiver element and then subtracting that value from the densitometer 62 reading of the transport web 68 where the patch exists to arrive at a net patch voltage $V_{TD}$. The aim voltage $V_{TD_aim}$ is then subtracted from the measured net patch voltage $V_{TD}$ to determine $\Delta V_{TD}$. The parameters ALPHA and BETA contained in Table 1 are represented as: $\alpha$ for the proportionality constant between a measured $V_{TD}$ and the required $V_o$ change; and $\beta$ for the proportionality constant between the $V_{TD}$ and the $E_o$ change. Adjustments to $V_{o\text{-}aim}$ (76), which result in the determined value $\Delta V_{o\text{-}aim}$, are calculated by relationship ($\alpha^*\Delta V_{TD}$) where $\alpha$ is the fixed value gain illustrated in Table 1. Similarly, adjustments to $E_{o\text{-}aim}$ (75), which result in the determined value $\Delta E_{o\text{-}aim}$, are calculated by ($\beta^*\Delta V_{TD}$) where $\beta$ is another fixed value gain. The values for $\alpha$ and $\beta$ must have the proper ratio to each other to maintain tonescale. The magnitude of these two values, are established so that a $V_{TD}$ error is substantially corrected by a single $V_o$ and $E_o$ adjustment.

Primary charger 61 is supplied with a grid potential that determines the potential that is applied to the photoconductive member 63 based on determine $\Delta V_o$ (81), calculate $\Delta V_{grid}$ (82) and determine $V_{grid}^{new}$ (83), which will be discussed more in detail, hereinbelow.

A global exposure variable is used to proportionally change the intensity of the image-wise exposure as a means to control the image density. If the global exposure, referred to herein as $E_o$, is increased, the density of the output image will also increase. A toning system is used to render the latent image as a visible image using pigmented toner to physically create the image. A toning bias voltage, $V_{bias}$ is applied to the toning system with a fixed offset from $V_o$ such that charged toner is repelled from the unexposed regions of the latent image, but attracted to exposed regions. $V_{bias}$ as seen in FIG. 3 is offset from $V_o^{new}$ by 85 volts. The mass density of toner developed is related to the toning potential, which is the potential difference between the toning bias, $V_{bias}$, and surface potential on the photoconductive member 63 in exposure areas, $E_o$. The mass density of toner will increase if either $V_o$ or $E_o$ is increased. However, the tonescale response of the output image will be best preserved if the $V_o$ and $E_o$ adjustments are done in fixed ratio to each other.

Still referring to FIG. 3, the print density control function employed by the process control uses the EP modules 52 to expose a process control patch on the transport web 68 in the inter-frame space between receiver sheets. Preferably, numerous patches will be made each using an individual colorant. A transmission densitometer 62 measures the density of the process control patch on a clear transport web 68 where the patch is positioned between the receiver elements or sheets. An illumination source, such as an LED (not shown), is positioned above the process control patch, with a photodetector (not shown) located below the patch. A logarithmic amplifier produces a 5 volt per decade output in relation to the current in the photodetector. The circuit is adjusted so that the null reading without a patch is near the bottom range of detection (for example 1 volt on a 0–10 volt scale). If a 1.0 transmission density image is placed within the emitter/detector pair, 90% of the light is absorbed creating a proportional change in current generation in the photodetector circuit, and will cause a 5 volt change in the logarithmic amplifier output from 1 volt to 6 volts. The net change in output from the transmission densitometer is referred to Voltage Transmission Density, or $V_{TD}$.

The invention has been described in detail with particular reference to certain preferred embodiments thereof, but it will be understood that variations and modifications can be effected within the spirit and scope of the invention.

What is claimed is:

1. A color printing system comprising:

a plurality of color modules;

a processing element associated with each of said color modules;

a set of configurable parameters related to individual ones of said color modules and stored in respective process elements of said color modules as a series of addressable tables; and a common bus structure coupled to each of said color modules and said processing elements, wherein said color modules are a series of addressable nodes on said common bus and said processing element initializes said color modules via said common bus using said addressable nodes as identifications for inputs to each of said color modules to properly initialize said parameters for correct color settings.

2. The system of claim 1, wherein, during initialization, each of said color modules has said parameters set using a unique identification number that allows fully independent configuration and control for each of said color modules.

3. The system of claim 2, wherein once said parameters are initialized, a personality for each of said color modules is established and said processing element performs checks on components for each of said color modules to insure said personality is correct.

4. The system of claim 3, wherein said processing element will change said parameters if said personality is not correct.

5. The system of claim 1, wherein said processing element is a master processor and further comprising at least one additional local processor that maintains said configurable parameters.

* * * * *